US006568913B1

(12) United States Patent
Strikis et al.

(10) Patent No.: US 6,568,913 B1
(45) Date of Patent: May 27, 2003

(54) LUBRICATION PUMP FOR A SWASH PLATE TYPE COMPRESSOR

(75) Inventors: Guntis V. Strikis, Belleville, MI (US); Shane A. Harte, Farmington Hills, MI (US); Yong Huang, Ann Arbor, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 88 days.

(21) Appl. No.: 09/747,623

(22) Filed: Dec. 22, 2000

(51) Int. Cl.[7] ..... F04B 23/08; F04B 1/26

(52) U.S. Cl. ..... 417/199.1; 417/269; 417/222.2; 184/6.17

(58) Field of Search ..... 417/269, 222.2, 417/199.1; 184/6.17, 6.16, 6.28

(56) References Cited

U.S. PATENT DOCUMENTS

| | | | | |
|---|---|---|---|---|
| 862,867 A | | 8/1907 | Eggleston | 417/390 |
| 2,013,478 A | | 9/1935 | Read | 184/32 |
| 3,604,314 A | | 9/1971 | Steiner | 91/485 |
| 4,090,430 A | * | 5/1978 | Matsumoto et al. | 417/269 |
| 4,239,466 A | * | 12/1980 | Abbey | 418/11 |
| 4,421,453 A | | 12/1983 | Hoff et al. | 415/88 |
| 4,561,829 A | * | 12/1985 | Iwata et al. | 184/6.16 |
| 5,009,286 A | * | 4/1991 | Ikeda et al. | 184/6.17 |
| 5,088,897 A | | 2/1992 | Kawai et al. | 417/269 |
| 5,678,657 A | * | 10/1997 | Lee | 137/533.21 |
| 5,772,407 A | * | 6/1998 | Kato et al. | 417/269 |

FOREIGN PATENT DOCUMENTS

| | | |
|---|---|---|
| JP | 8-109877 | * 4/1996 |
| JP | 8-303345 | * 11/1996 |
| JP | 9-273479 | * 10/1997 |
| WO | WO 89/02532 | 3/1989 |

* cited by examiner

*Primary Examiner*—Charles G. Freay
*Assistant Examiner*—Michael K. Gray
(74) *Attorney, Agent, or Firm*—Scott M. Confer

(57) ABSTRACT

A variable displacement swash plate type compressor which incorporates a lubricant pump coupled to one end of the drive shaft of the compressor, wherein the lubricant pump provides positive lubricant flow within the compressor and facilitates the lubrication of compressor components.

5 Claims, 2 Drawing Sheets

LUBRICATION PUMP FOR A SWASH PLATE TYPE COMPRESSOR

FIELD OF THE INVENTION

The present invention relates to a variable displacement swash plate type compressor adapted for use in an air conditioning system for a vehicle, and more particularly to a lubricant pump coupled to one end of the drive shaft of the compressor to provide positive lubricant flow within the compressor and facilitate the lubrication of compressor components.

BACKGROUND OF THE INVENTION

Variable displacement swash plate type compressors typically include a cylinder block provided with a number of cylinders, a piston disposed in each of the cylinders of the cylinder block, a crankcase sealingly disposed on one end of the cylinder block, a rotatably supported drive shaft, and a swash plate. The swash plate is adapted to be rotated by the drive shaft. Rotation of the swash plate is effective to reciprocatively drive the pistons. The length of the stroke of the pistons is varied by the inclination of the swash plate. Inclination of the swash plate is varied by controlling the pressure differential between a suction chamber and a crank chamber. The pressure differential is typically controlled using a control valve and an orifice tube which facilitates fluid communication between a discharge chamber and the crank chamber to convey compressed gases from the discharge chamber to the crank chamber based on pressure in a suction chamber.

The compressor arrangements of the prior art rely primarily on refrigerant flow to transport lubricant within the compressor. Therefore, ineffective lubrication of the close tolerance moving parts within the crank chamber occurs due to the lack of consistent flow of refrigerant gas from the discharge chamber to the crank chamber.

An object of the present invention is to produce a swash plate type compressor wherein positive lubricant flow within the compressor is achieved to result in improved lubrication of the compressor components.

SUMMARY OF THE INVENTION

The above, as well as other objects of the invention, may be readily achieved by a variable displacement swash plate type compressor comprising: a cylinder block having a plurality of cylinders arranged radially therein; a piston reciprocatively disposed in each of the cylinders of the cylinder block; a cylinder head attached to the cylinder block; a crankcase cooperating with the cylinder block to define a crank chamber; a drive shaft rotatably supported by the crankcase and the cylinder block; a swash plate adapted to be driven by the drive shaft, the swash plate having a central aperture for receiving the drive shaft, radially outwardly extending side walls, and a peripheral edge; and a lubricant pump coupled to one end of the drive shaft to provide positive lubricant flow within the compressor.

BRIEF DESCRIPTION OF THE DRAWINGS

The above, as well as other objects, features, and advantages of the present invention will be understood from the detailed description of the preferred embodiment of the present invention with reference to the accompanying drawings, in which.

DETAILED DESCRIPTION OF THE PREFERRED EMBODIMENT

Figure 1:
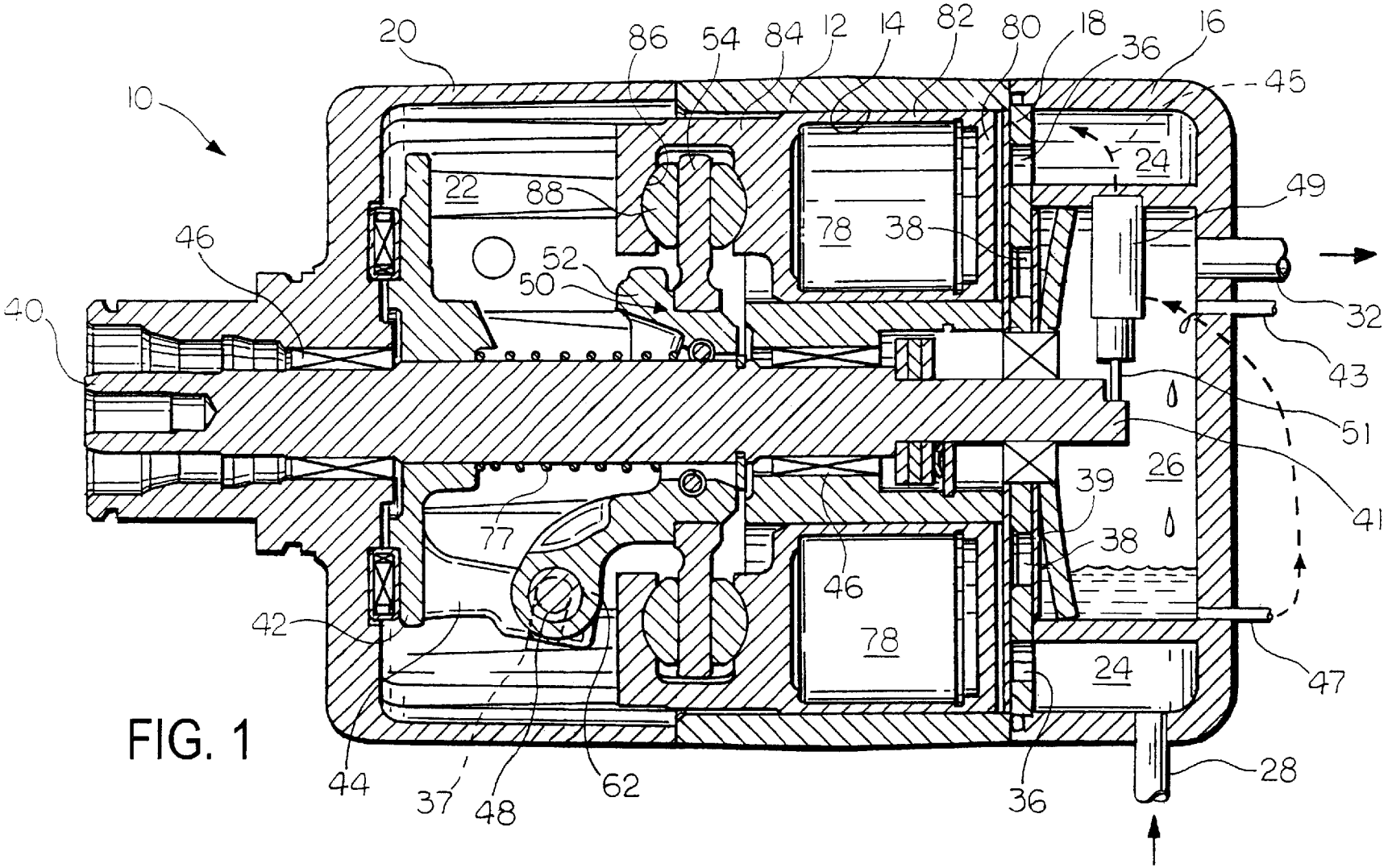
FIG. 1 is a cross sectional elevational view of a variable displacement swash plate type compressor incorporating the features of the invention, showing a pump connected to one end of the drive shaft pump.

Referring now to the drawings, and particularly FIG. 1, there is shown generally at 10 a variable displacement swash plate type compressor incorporating the features of the invention. The compressor 10 includes a cylinder block 12 having a plurality of cylinders 14. A cylinder head 16 is disposed adjacent one end of the cylinder block 12 and sealingly closes the end of the cylinder block 12. A valve plate 18 is disposed between the cylinder block 12 and the cylinder head 16. A crankcase 20 is sealingly disposed at the other end of the cylinder block 12. The crankcase 20 and cylinder block 12 cooperate to form an airtight crank chamber 22.

The cylinder head 16 includes a suction chamber 24 and a discharge chamber 26. An inlet port 28 and associated inlet conduit provide fluid communication between the evaporator (not shown) of the cooling portion of the air conditioning system for a vehicle and the suction chamber 24. An outlet port 32 and associated outlet conduit provide fluid communication between the discharge chamber 26 and the cooling portion of the air conditioning system for a vehicle. Suction ports 36 provide fluid communication between the suction chamber 24 and each cylinder 14. Each suction port 36 is opened and closed by a suction valve. Discharge ports 38 provide fluid communication between each cylinder 14 and the discharge chamber 26. Each discharge port 38 is opened and closed by a discharge valve. A retainer 39 restricts the opening of the discharge valve.

A drive shaft 40 is centrally disposed in and arranged to extend through the crankcase 20 to the cylinder block 12. The drive shaft 40 is rotatably supported in the crankcase 20 by suitable bearings 46.

Figure 2:
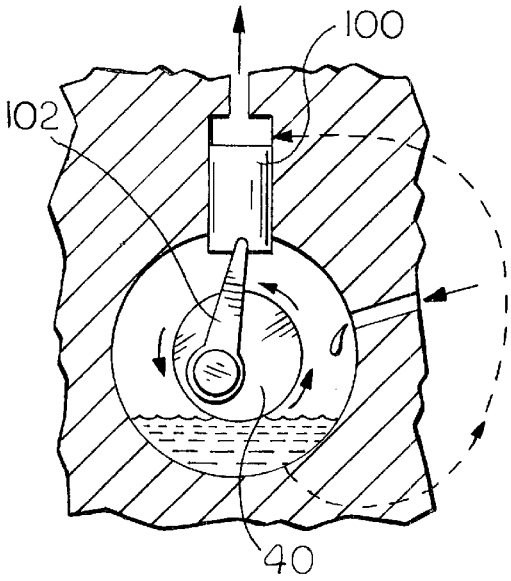
FIG. 2 is a schematic view of an embodiment of the invention illustrating a lubricant pump coupled to the drive shaft of the compressor by means of a crank pin and an associated crank shaft.

Another embodiment of the invention is illustrated in FIG. 2 wherein a piston pump 100 is driven by a linkage drivingly engaged with the drive shaft 40 such as a connecting rod 102 eccentrically mounted on the drive shaft 40 of the associated compressor 10. In all other respects, the lubricating system is the same as that illustrated and described in respect of FIG. 1.

A swash plate 50 is formed to include a hub 52 and an annular plate 54 with opposing sides and a peripheral marginal edge. The hub 52 includes an annular main body having a centrally disposed aperture formed therein and an arm 62 that extends outwardly and perpendicularly from the surface of the hub 52. An aperture is formed in the distal end of the arm 62 of the hub 52. One end of the pin 48 is slidingly disposed in the slot 37 of the arm 44 of the rotor 42, while the other end is fixedly disposed in the aperture of the arm 62.

The annular plate 54 has a centrally disposed aperture formed therein to receive the annular main body of the hub 52. The annular main body is press fit in the aperture of the annular plate 54. The drive shaft 40 is adapted to extend through the hollow annular main body of the hub 52.

A helical spring 77 is disposed to extend around the outer surface of the drive shaft 40. One end of the spring 77 abuts the rotor 42, while the opposite end abuts the hub 52 of the swash plate 50.

A piston 78 is slidably disposed in each of the cylinders 14 in the cylinder block 12. Each piston 78 includes a head 80, a middle portion 82, and a bridge portion 84. The middle portion 82 terminates in the bridge portion 84 defining an interior space for receiving the peripheral marginal edge of the annular plate 54. Spaced apart concave shoe pockets 86 are formed in the interior space of the bridge portion 84 for rotatably containing a pair of semi-spherical shoes 88. The spherical surfaces of the shoes 88 are disposed in the shoe pockets 86 with a flat bearing surface disposed opposite the spherical surface for slidable engagement with the opposing sides of the annular plate 54.

The operation of the compressor 10 is accomplished by rotation of the drive shaft 40 by an auxiliary drive means (not shown), which may typically be the internal combustion engine of an associated vehicle. Rotation of the drive shaft 40 causes the rotor 42 to correspondingly rotate with the drive shaft 40. The swash plate 50 is connected to the rotor 42 by a hinge mechanism formed by the pin 48.slidingly disposed in the slot 37 of the arm 44 of the rotor 42 and fixedly disposed in the aperture of the arm 62 of the hub 52. As the rotor 42 rotates, the connection made by the pin 48 between the swash plate 50 and the rotor 42 causes the swash plate 50 to rotate. During rotation, the swash plate 50 is disposed at an inclination. The rotation of the swash plate 50 is effective to reciprocatively drive the pistons 78. The rotation of the swash plate 50 further causes a sliding engagement between the opposing sides of the annular plate 54 and the cooperating spaced apart shoes 88. The reciprocation of the pistons 78 causes refrigerant gas to be introduced from the suction chamber 24 into the respective cylinders 14 of the cylinder head 16. The reciprocating motion of the pistons 78 then compresses the refrigerant gas within each cylinder 14. When the pressure within each cylinder 14 exceeds the pressure within the discharge chamber 24, the compressed refrigerant gas is discharged into the discharge chamber 26.

The capacity of the compressor 10 can be changed by changing the inclination of the swash plate 50 and thereby changing the length of the stroke for the pistons 78. The inclination of the swash plate 50 is changed by controlling the pressure differential between the crank chamber 22 and the suction chamber 24. The pressure differential is controlled by controlling the net flow of refrigerant gas from the at least one cylinder 14 to the crank chamber 22.

Specifically, as the piston 78 is caused to move toward a bottom dead center position, the pressure within the cylinder 14 is less than the pressure within the suction chamber 24. A suction valve is caused to open causing refrigerant gas to flow into the cylinder 14 through the suction port 36. The pressure within the crank chamber 22 remains at a level between the pressure within the suction chamber 24 and the pressure within the discharge chamber 26 during rotation of the drive shaft 40.

Conversely, as the piston 78 is caused to move toward a top dead center position, the refrigerant gas within the cylinder 14 is compressed until the pressure within the cylinder 14 is caused to exceed the pressure within the discharge chamber 26. A discharge valve is caused to open and refrigerant gas is caused to flow through the discharge port 38 to the discharge chamber 26.

Further, as the piston 78 is caused to move toward a bottom dead center position within the at least one cylinder 14, the pressure within the cylinder 14 is less than the pressure within the crank chamber 22, causing refrigerant gas to flow to the cylinder 14. As the piston 78 is caused to move toward a top dead center position, the refrigerant gas within the cylinder 14 is compressed causing the pressure within the cylinder 14 to increase and exceed the pressure within the crank chamber 22. When the pressure within the cylinder 14 exceeds the pressure within the crank chamber 22, refrigerant gas is caused to flow to the crank chamber 22. Additionally, as the refrigerant gas within the cylinder 14 is compressed, the net flow and the rate of flow of refrigerant gas from the cylinder 14 to the crank chamber 22 are increased and become positive.

It is contemplated by the present invention to further increase the lubricating efficiency of the compressor 10 by providing a positive lubricant flow within the compressor 10 through the utilization of an auxiliary pump driven by the drive shaft 40 of the compressor.

The resulting system will provide positive lubricant flow within the compressor 10 to effectively lubricate critical areas of the compressor 10 without relying on refrigerant flow. Prior systems typically rely on the flow of refrigerant to transport the lubricant through the compressor. In cases of low refrigerant flow rates, the resultant lubrication was sometimes not adequate to achieve maximum performance and life span to the compressor.

Attention is directed to FIG. 1 which discloses the addition of a lubricant receiving reservoir which surrounds the terminal end 41 of the drive shaft 40. The reservoir is defined by the discharge chamber 26 an oil inlet 43, an oil outlet 45, and a suction line 47 interconnecting the sump portion of the reservoir with an oil inlet of an associated pump 49.

The pump 49 is a piston-type pump having a reciprocatively mounted operating rod 51. The end of the rod 51 is caused to be in contact with a cam surface formed on the end 41 of the drive shaft 40. As the drive shaft 40 is rotated, the operating rod 51 is caused to be reciprocated to drive a piston of the pump 49 which in turn discharges lubricating oil to critical parts of the compressor through the oil outlet 45.

It will be appreciated that the lubricating oil introduced into the reservoir through the inlet 43 is routed from a refrigerant/oil separator located remotely of the compressor (not shown).

Another embodiment of the invention is illustrated in FIG. 2 wherein a piston pump 100 is driven by a linkage drivingly engaged with and pivotally attached to the drive shaft 40 such as a connecting rod 102 eccentrically mounted on the drive shaft 40 of the associated compressor 10. In all other respects, the lubricating system is the same as that illustrated and described in respect of FIG. 1.

Figure 3:
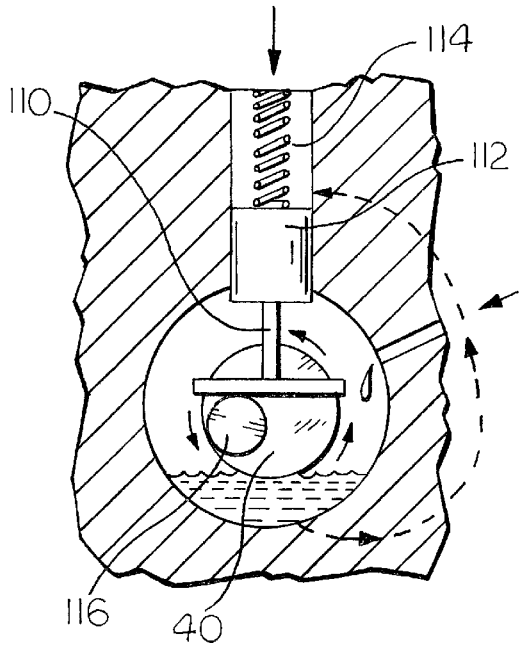
FIG. 3 is a schematic view of another embodiment of the invention illustrating a lubricant pump having an inverted T-shaped piston rod driven by a crank pin and an associated crank shaft.

Still another embodiment of the invention is illustrated in FIG. 3 wherein the piston 110 of the lubricating pump 112 is biased by a compression spring 114 which functions to bias the inverted T-shaped piston 110 of the pump 112 against an eccentrically formed cam member 116 on the end of the driveshaft 40.

Figure 4:
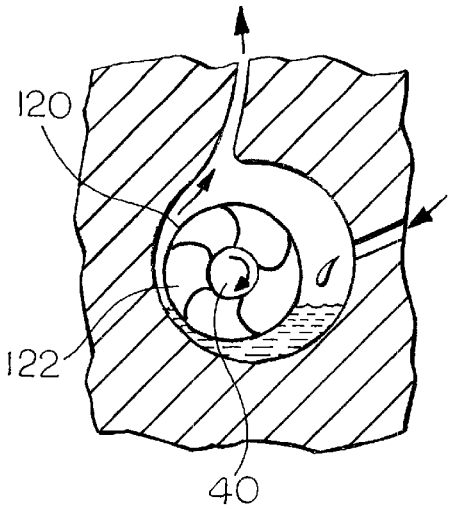
FIG. 4 is a schematic view of still another embodiment of the invention illustrating a centrifugal pump driven by one end of the compressor drive shaft.

It will be understood that the piston pump could be replaced by a centrifugal pump 120, as illustrated in FIG. 4, wherein the drive shaft 40 of the compressor 10 could be connected to the impeller 122 of the centrifugal pump 120 which would be effective to pump the lubricant through the compressor system.

In a like manner, the use of types of pumps such as a gear pump, trochoidal pump, vane type pump, bellows, scroll or screw type could be coupled to the end of the drive shaft to pump lubricant through the compressor system.

Figure 5:
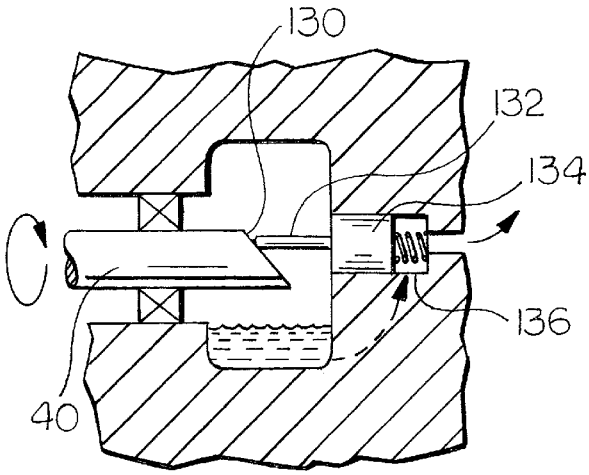
FIG. 5 is a schematic view of a lubricant pump driven in an axial direction by the one end of the drive shaft of the compressor.

FIG. 5 shares still another embodiment of the invention whereas the pumping action is accomplished in an axial direction in respect of the axis of the drive shaft 40 of the compressor 10. In the illustrated embodiment, the end of the drive shaft 40 of the compressor 10 is formed with a camming surface 130 which is used to cam a piston rod 132 of a spring biased piston 134 of a piston pump 136.

It will further be understood that while the aforedescribed embodiments of the invention have utilized a pumping member which is attached to the end of the compressor drive shaft, satisfactory results can likewise be achieved by transferring the rotating shaft energy to an associated lubricant pump by means of cams and/or linkages.

An additional benefit of the present invention is that oil present in the refrigerant gas provides lubrication to the close tolerance moving components of the compressor 10. The lubrication maximizes the durability of the compressor 10.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A variable displacement swash plate type compressor comprising:

a cylinder block having a plurality of cylinders arranged radially therein;

a piston reciprocatively disposed in each of the cylinders of said cylinder block;

a cylinder head attached to said cylinder block;

a crankcase cooperating with said cylinder block to define a crank chamber;

a drive shaft rotatably supported by said crankcase and said cylinder block, said drive shaft having a first end and a second end;

a linkage drivingly engaged with the first end of said drive shaft;

a swash plate adapted to be driven by said drive shaft, said swash plate having a central aperture for receiving said drive shaft, radially outwardly extending side walls, and a peripheral edge; and a lubricant pump drivingly engaged with said linkage to provide positive lubricant flow within the compressor.

2. A variable capacity swash plate type compressor as defined in claim 1, wherein said pump is a piston-type pump.

3. A variable displacement swash plate type compressor comprising:

a cylinder block having a plurality of cylinders arranged radially therein;

a piston reciprocatively disposed in each of the cylinders of said cylinder block;

a cylinder head attached to said cylinder block;

a crankcase cooperating with said cylinder block to define a crank chamber;

a drive shaft rotatably supported by said crankcase and said cylinder block, said drive shaft having a first end and a second end;

a linkage pivotally attached to the first end of said drive shaft;

a swash plate adapted to be driven by said drive shaft, said swash plate having a central aperture for receiving said drive shaft, radially outwardly extending side walls, and a peripheral edge; and a lubricant pump drivingly engaged with said linkage to provide positive lubricant flow within the compressor.

4. A variable capacity swash plate type compressor as defined in claim 3, wherein said pump is a piston-type pump.

5. A variable displacement swash plate type compressor comprising:

a cylinder block having a plurality of cylinders arranged radially therein;

a piston reciprocatively disposed in each of the cylinders of said cylinder block;

a cylinder head attached to said cylinder block;

a crankcase cooperating with said cylinder block to define a crank chamber;

a drive shaft rotatably supported by said crankcase and said cylinder block, said drive shaft having a first end and a second end;

a connecting rod having a first end and a second end, the first end of said connecting rod eccentrically and pivotally attached to the first end of said drive shaft;

a swash plate adapted to be driven by said drive shaft, said swash plate having a central aperture for receiving said drive shaft, radially outwardly extending side walls, and a peripheral edge; and a piston-type lubricant pump to provide positive lubricant flow within the compressor, said pump having a piston reciprocally disposed therein, the piston connected to said connecting rod.

* * * * *